US007425805B2

(12) United States Patent
Hsu

(10) Patent No.: US 7,425,805 B2
(45) Date of Patent: Sep. 16, 2008

(54) THREE-IN-ONE CONTROL DEVICE FOR A CEILING FAN

(76) Inventor: Hsia-Yuan Hsu, No. 19, Alley 148, Lane 86, Sec. 2, Songjhu Rd., Beitun District, Taichung City 406 (TW)

( * ) Notice: Subject to any disclaimer, the term of this patent is extended or adjusted under 35 U.S.C. 154(b) by 32 days.

(21) Appl. No.: 11/580,290

(22) Filed: Oct. 13, 2006

(65) Prior Publication Data

US 2008/0088270 A1 Apr. 17, 2008

(51) Int. Cl.
*H02P 7/36* (2006.01)
*H04Q 7/02* (2006.01)
*F04D 25/08* (2006.01)

(52) U.S. Cl. ..... 318/16; 318/256; 318/257; 318/280; 318/480; 417/326; 361/23; 361/103; 340/825.69

(58) Field of Classification Search ..... 318/16, 318/256, 257, 280, 284, 480; 417/326; 416/5; 361/23, 103; 307/80; 340/825.69
See application file for complete search history.

(56) References Cited

U.S. PATENT DOCUMENTS 4,465,956 A * 8/1984 Fowler ..... 318/268
4,494,055 A * 1/1985 Bitting et al. ..... 318/400.09
4,500,821 A * 2/1985 Bitting et al. ..... 318/400.05
4,719,446 A * 1/1988 Hart ..... 340/310.11
4,818,920 A * 4/1989 Jacob ..... 318/16
4,935,736 A * 6/1990 Meierdierck ..... 340/825.69
5,041,825 A * 8/1991 Hart et al. ..... 340/3.4
5,164,644 A * 11/1992 Hsieh ..... 318/284
5,189,412 A * 2/1993 Mehta et al. ..... 340/825.22
6,120,262 A * 9/2000 McDonough et al. .... 417/424.1
6,198,408 B1 * 3/2001 Cohen ..... 340/825.69
6,211,632 B1 * 4/2001 Liao ..... 318/16
2004/0191087 A1 * 9/2004 Liu ..... 417/326

* cited by examiner

*Primary Examiner*—Paul Ip
(74) *Attorney, Agent, or Firm*—Ming Chow; Sinorica, LLC

(57) ABSTRACT

A three-in-one control device for a ceiling fan includes a signal receiving module, which is able to receive segmented controlled signals, stepless controlled signals and wireless controlled signals respectively, for transmitting controlled signals to a micro computer control unit to process, analyze and code them. Then, the processed signals are transmitted to a driving unit to drive the blades of the ceiling fan to rotate. Therefore, when a control switch is replaced with another type, it is unnecessary to change the control device but just connect it to a corresponding control module, able to save manufacturing cost.

8 Claims, 3 Drawing Sheets

THREE-IN-ONE CONTROL DEVICE FOR A CEILING FAN

BACKGROUND OF THE INVENTION

1. Field of the invention

This invention relates to a control device for a ceiling fan, particularly to one able to connect with three different control modules.

2. Description of the Prior Art

Commonly, a conventional ceiling fan with a modern or retro-chic or gorgeous feature is not only used as an indoor air-conditioner, but also an indoor decoration, almost a necessary household appliance for a family. Such a conventional ceiling fan hung under a ceiling is controlled by a switch to transmit a signal to a control circuit installed inside it to speed up or slow down the motor for changing flow rate. But, the control circuit installed properly inside the fan is merely corresponding to a certain sort of control switch. That is, if the control switch is a segmented switch, the control circuit of the fan has to be the one able to receive signals controlled by the segmented switch. When the control switch is to be replaced with a different one, the control circuit inside the fan has also to be replaced with another for matching with the new control switch. Therefore, it is very inconvenient for assembly, causing a high manufacturing cost.

SUMMARY OF THE INVENTION

The objective of this invention is to offer a three-in-one control device for a ceiling fan.

The main characteristics of the invention is a signal receiving module provided in the control device that is able to receive segmented controlled signals, stepless controlled signals and wireless controlled signals respectively, for transmitting controlled signals to a micro computer control unit to process, analyze and code them. Then, the processed signals are transmitted to a driving unit to drive the blades of the ceiling fan to rotate. Therefore, when a control switch is replaced with another type, it is unnecessary to change the control device but just connect it to a corresponding control module, able to save manufacturing cost.

BRIEF DESCRIPTION OF DRAWINGS

This invention is better understood by referring to the accompanying drawings, wherein.

DETAILED DESCRIPTION OF THE PREFERRED EMBODIMENT

Figure 1:
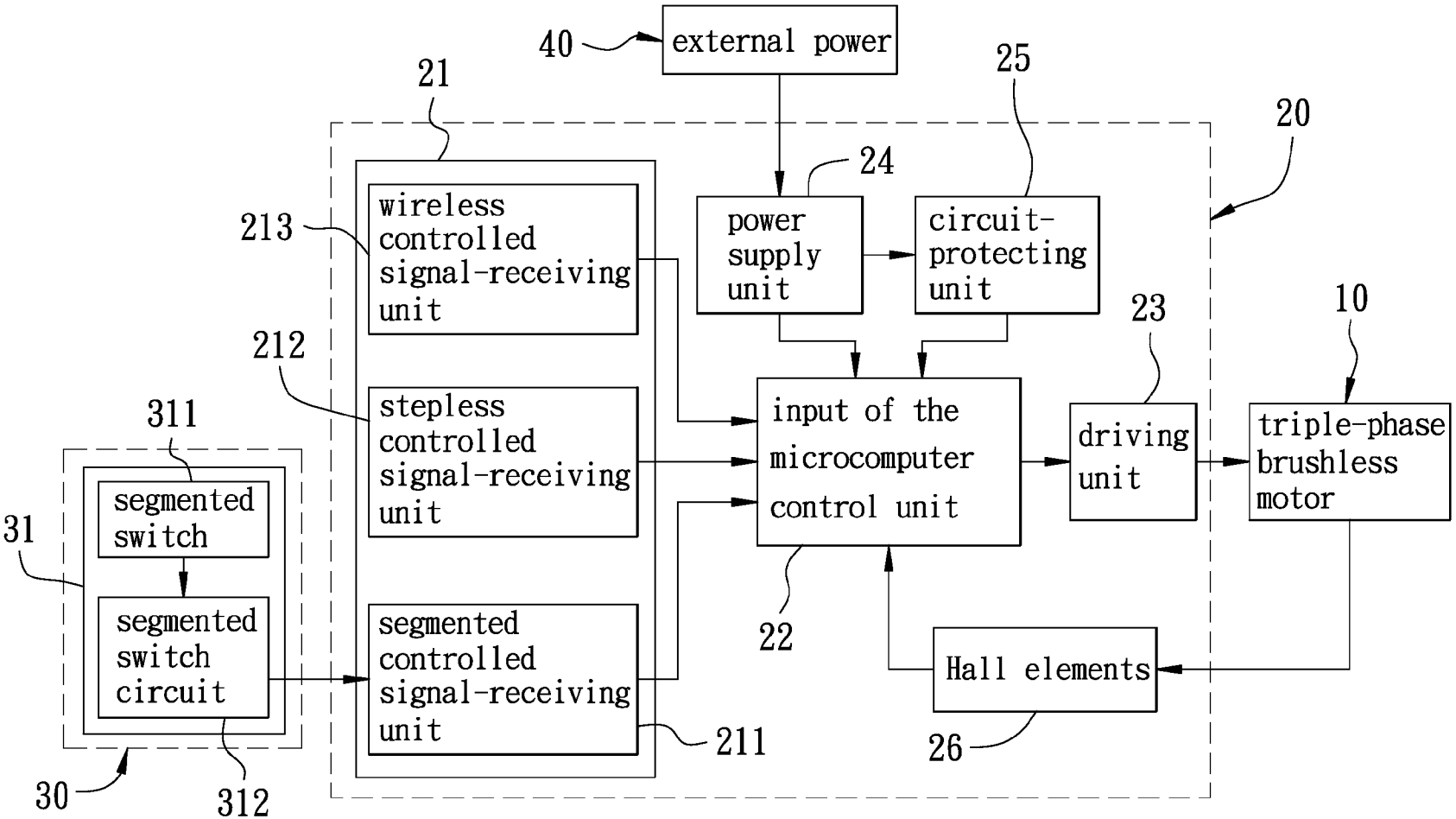
FIG. 1 is a circuit block diagram of a first preferred embodiment of a three-in-one control device for a ceiling fan in the present invention.

FIG. 1 shows a circuit block diagram of a first preferred embodiment of a three-in-one control device for a ceiling fan in the present invention. The blades of the ceiling fan are driven to rotate by a triple-phase brushless motor 10 installed with a built-in control device 20 inside a shell. The control device 20 is connected with a control module 30 to control the triple-phase brushless motor 10 to spin, depending on requirement. The present invention is composed of the control device 20 and the control module 30.

The control device 20 fixed properly on a PC board is provided with a signal receiving module 21, a micro computer control unit 22, a driving unit 23, a power supply unit 24, a circuit protecting unit 25 and at least three Hall elements 26. The signal-receiving module 21 is composed of a segmented signal-receiving unit 211, a stepless controlled signal-receiving unit 212 and a wireless controlled signal receiving unit 213. Signals transmitted by the control module 30 are to be received by the receiving units of the signal-receiving module 21. The control module 30 is composed of a segmented control unit 31, a stepless control unit 32 and a wireless control unit 33. It is the segmented control unit 31 of the control module 30 connected effectively in the first embodiment of the invention. The segmented control unit 31 is provided with a segmented switch 311 and a segmented switch circuit 312 for transmitting segmented controlled signals indicated by the segmented switch 311 to the segmented controlled signal-receiving unit 211 of the signal-receiving module 21. Then, the segmented controlled signals are transmitted to an input of the microcomputer control unit 22. The Hall elements 26 fixed properly on preset positions of the PC board of the control device 20 are to simultaneously induce displacement of a magnetic device of the triple-phase brushless motor 10 and then feedback respond signals to the input of the micro computer control unit 22, which is then to process, analyze and code the signals. Next, the signals are transmitted to the driving unit 23 for driving the triple-phase brushless motor 10 to keep its blades rotated under a controlled RPM. Moreover, the microcomputer control unit 22 is connected with the power supply unit 24, which is able to convert the voltage of an external power 40 into various ones needed by the control device 20. The circuit-protecting unit 25 is connected between the microcomputer control unit 22 and the power supply unit 24 to protect the control device 20 in case of over voltage, over current and over heat.

Figure 2:
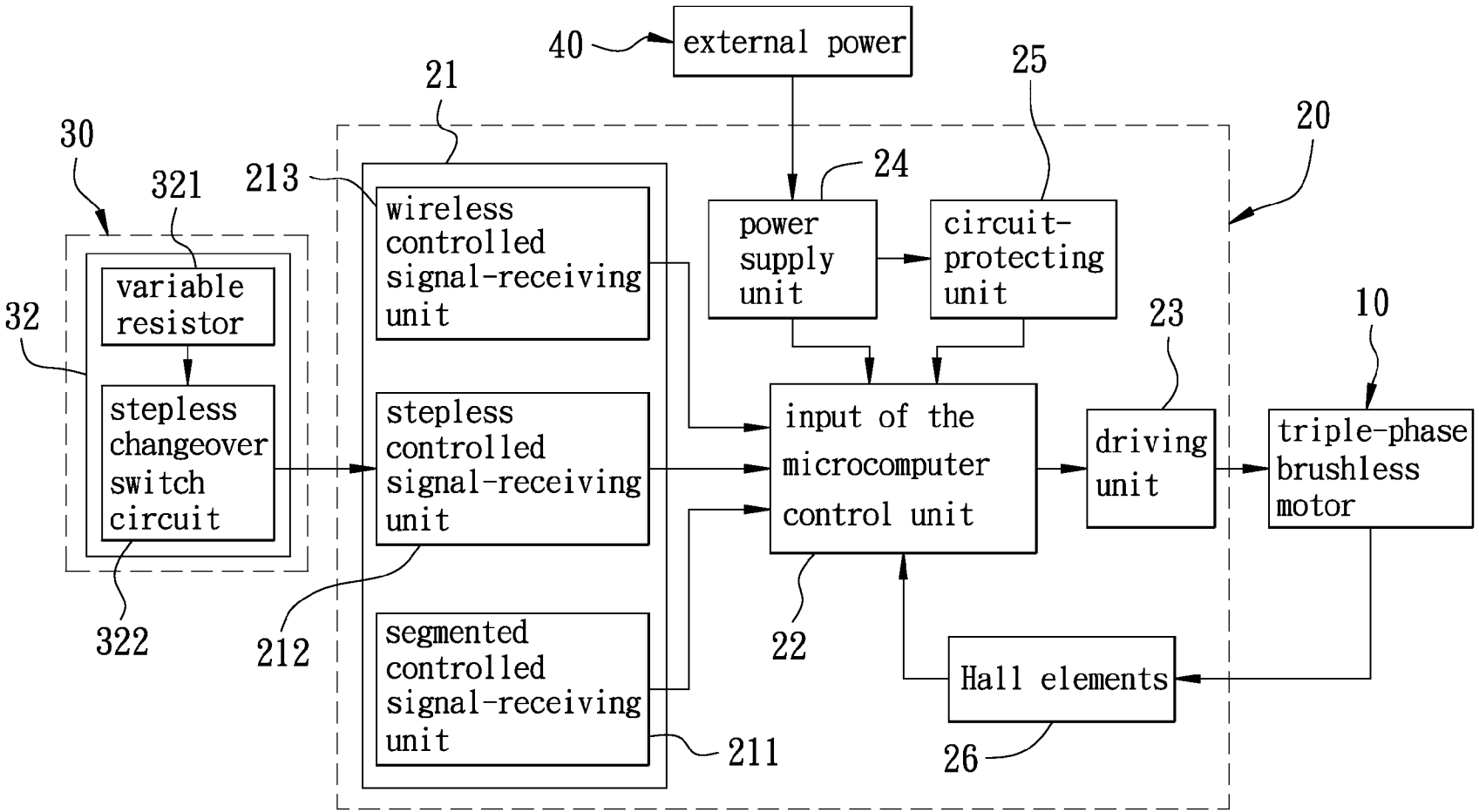
FIG. 2 is a circuit block diagram of a second preferred embodiment of a three-in-one control device for a ceiling fan in the present invention.

FIG. 2 shows a circuit block diagram of a second preferred embodiment of a three-in-one control device for a ceiling fan in the present invention. It has the same parts as the first one does except that the segmented control unit 31 is replaced with a stepless control unit 32. The stepless control unit 32 is provided with a variable resistor 321 and a stepless changeover switch circuit 322 for transmitting stepless controlled signals indicated by the variable resistor 321 to the stepless controlled signal receiving unit 212, which is then to transmit the stepless controlled signals to the input of the micro computer control unit 22 for controlling the RPM of the blades driven by the triple-phase brushless motor 10.

Figure 3:
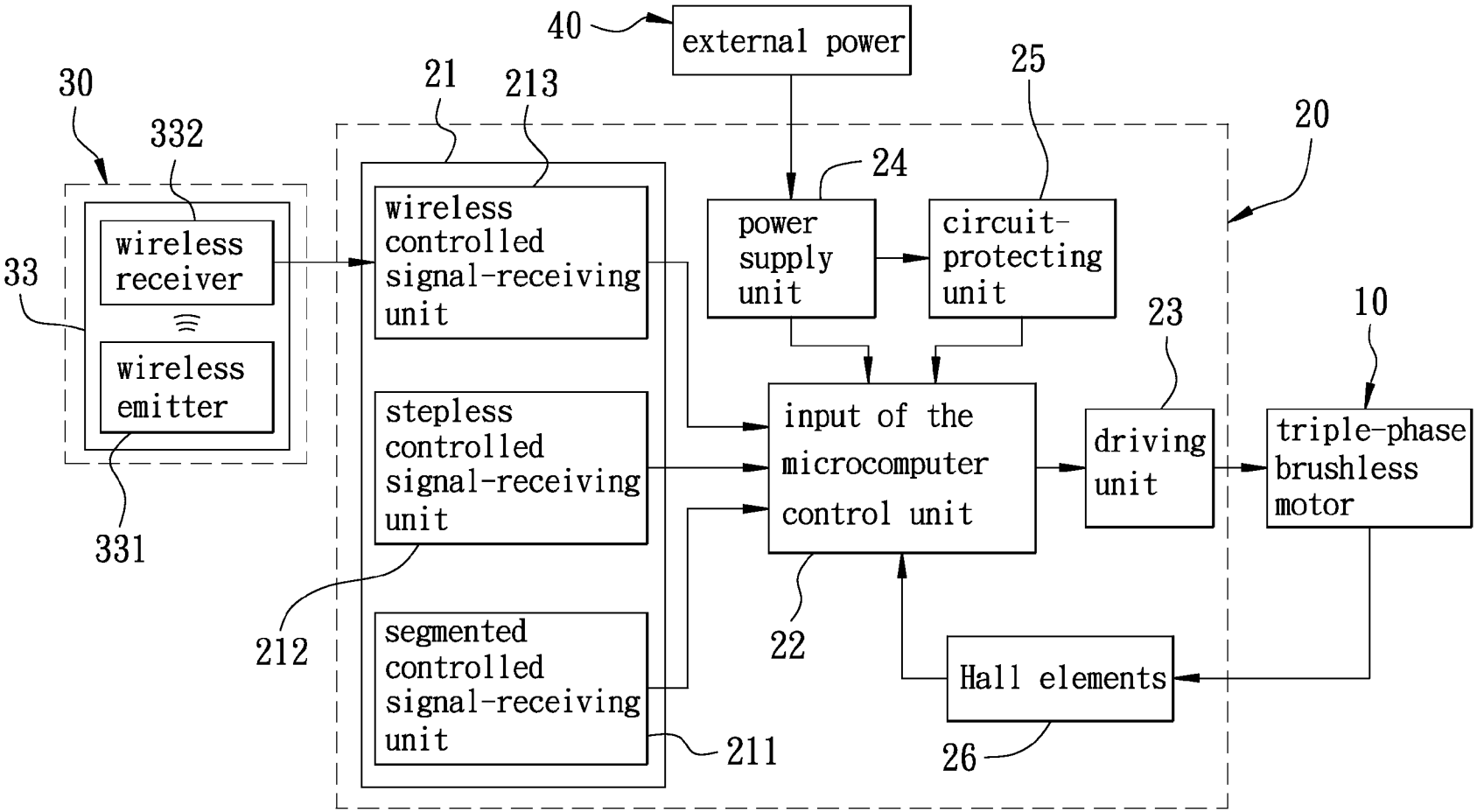
FIG. 3 is a circuit block diagram of a third preferred embodiment of a three-in-one control device for a ceiling fan in the present invention.

FIG. 3 shows a circuit block diagram of a third preferred embodiment of a three-in-one control device for a ceiling fan in the present invention. It has the same parts as the first one does except that the segmented control unit 31 is replaced with a wireless control unit 33. The wireless control unit 33 is provided with a wireless emitter 331 and a wireless receiver 332 for receiving wireless controlled signals emitted by wireless emitter 331 and then, transmitting them to the wireless controlled signal receiving unit 213, which is successively to transmit the wireless controlled signals to the input of the micro computer control unit 22 for controlling the RPM of the blades driven by the triple-phase brushless motor 10.

In assembly, as shown in FIG. 3, when a customer's order of the triple-phase brushless motor 10 demands the wireless control unit 33 to be used as the control module 30, just install the wireless receiver 332 inside the shell of the fan properly to keep its output connected with the input of the wireless controlled signal receiving unit 213 of the signal receiving module 21. Then, a user can control the wireless emitter 331 to send out a wireless controlled signal for the wireless receiver 332 to receive and then, to transmit it to the wireless controlled signal receiving unit 213 of the signal receiving module 21 and the input of the micro computer control unit 22 orderly, so that the signal is to be processed, analyzed and coded by the micro computer control unit 22 in order to be transmitted to the input of the driving unit 23 for driving the triple-phase brushless motor to enable the blades of the fan to start rotating.

The invention has the following advantages as can be seen from the foresaid description.

1. Because the signal receiving module 21 has three different controlled signal receiving units able to receive corresponding controlled signals transmitted by the control module 30, it needs only to change the control module 30 as required, instead of changing the control device 20 as the conventional one does.

2. The power supply unit 24 can protect the control device from damaged owing to over voltage, over current and over heat.

3. The driving unit 23 can drive an induced motor or a brushless motor. If a brushless motor is used, it needs to be connected with plural Hall elements.

While the preferred embodiment of the invention has been described above, it will be recognized and understood that various modifications may be made therein and the appended claims are intended to cover all such modifications that may fall within the spirit and scope of the invention.

What is claimed is:

1. A three-in-one control device for a ceiling fan, said ceiling fan having a motor and said control device installed inside a shell, said motor used to drive blades of said ceiling fan, said control device connected with a specific control module depending on requirement, and said control device fixed properly on a PC board and composed of a signal receiving module for receiving a controlled signal transmitted by said control module, a micro computer control unit used to process, analyze and code said controlled signal transmitted from said signal receiving module, and a driving unit for accepting the processed signal from said micro computer control unit to drive said motor, said signal receiving module composed of a segmented signal receiving unit, a stepless controlled signal receiving unit and a wireless controlled signal receiving unit, said micro computer control unit connected with a power supply unit for changing voltage of an external power into various voltages needed by said control device.

2. A three-in-one control device for a ceiling fan as claimed in claim 1, wherein said control module is a segmented control unit that is provided with a segmented switch and a segmented switch circuit able to transmit a controlled signal indicated by said segmented switch to said segmented controlled signal receiving unit of said signal receiving module.

3. A three-in-one control device for a ceiling fan as claimed in claim 1, wherein said control module is a stepless controlled signal receiving unit that is provided with a variable resistor and a stepless changeover switch circuit for transmitting a controlled signal indicated by said variable resistor to said stepless controlled signal receiving unit of said signal receiving module.

4. A three-in-one control device for a ceiling fan as claimed in claim 1, wherein said control module is a wireless controlled signal receiving unit that is provided with a wireless emitter and a wireless receiver able to receive a controlled signal sent by said wireless emitter and to transmit it to said wireless controlled signal receiving unit of said signal receiving module.

5. A three-in-one control device for a ceiling fan as claimed in claim 1, wherein said motor of said ceiling fan is a brushless motor, and said micro computer control unit is connected with at least three Hall elements that are to detect displacement of a magnetic device of said brushless motor and feedback a respond signal to said micro computer control unit so that said micro computer control unit can process, analyze and code the responded signal and transmit it to said driving unit to drive said brushless motor to rotate under a controlled RPM.

6. A three-in-one control device for a ceiling fan as claimed in claim 5, wherein said brushless motor is a triple-phase brushless motor and said Hall elements are fixed properly on said PC board of said control device to detect displacement of a magnetic device of said triple-phase brushless motor and feedback a responded signal to said micro computer control unit so that said micro computer control unit can process, analyze and code the responded signal and transmit it to said driving unit to drive said triple-phase brushless motor to rotate under a controlled RPM.

7. A three-in-one control device for a ceiling fan as claimed in claim 1, wherein said brushless motor is a triple-phase brushless motor and said micro computer control unit is connected with at least three Hall elements that are fixed properly on said PC board of said control device to detect displacement of a magnetic device of said triple-phase brushless motor and feedback a responded signal to said micro computer control unit so that said micro computer control unit can process, analyze and code the responded signal and transmit it to said driving unit to drive said triple-phase brushless motor to rotate under a controlled RPM.

8. A three-in-one control device for a ceiling fan as claimed in claim 1, wherein a circuit protecting unit is connected between said micro computer control unit and said power supply unit for preventing said control device from being damaged in case of over voltage, over current and over heat.

* * * * *